US008638287B2

(12) United States Patent
Kim

(10) Patent No.: US 8,638,287 B2
(45) Date of Patent: Jan. 28, 2014

(54) LIQUID CRYSTAL DISPLAY DEVICE AND METHOD FOR DRIVING THE SAME

(75) Inventor: Ki Duk Kim, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 1122 days.

(21) Appl. No.: 12/003,489

(22) Filed: Dec. 26, 2007

(65) Prior Publication Data

US 2008/0158139 A1 Jul. 3, 2008

(30) Foreign Application Priority Data

Dec. 27, 2006 (KR) ..... 10-2006-0134589

(51) Int. Cl.
*G09G 3/36* (2006.01)

(52) U.S. Cl.
USPC ..... 345/102; 345/98

(58) Field of Classification Search
USPC ..... 345/102, 84, 87, 98, 55, 204, 214; 348/631, 687–689
See application file for complete search history.

(56) References Cited

U.S. PATENT DOCUMENTS

| | | | | |
|---|---|---|---|---|
| 6,803,901 | B1 * | 10/2004 | Numao | 345/102 |
| 7,449,838 | B2 * | 11/2008 | Kumamoto | 315/169.1 |
| 2002/0003522 | A1 | 1/2002 | Baba et al. | |
| 2003/0043097 | A1 * | 3/2003 | Shingai et al. | 345/87 |
| 2004/0252097 | A1 * | 12/2004 | Kaneki et al. | 345/102 |
| 2006/0055659 | A1 * | 3/2006 | Bou-Chi et al. | 345/102 |
| 2006/0119294 | A1 * | 6/2006 | Oh et al. | 315/312 |

FOREIGN PATENT DOCUMENTS

| | | | |
|---|---|---|---|
| CN | 1356681 | | 7/2002 |
| CN | 1573450 | | 2/2005 |
| CN | 1782806 | | 6/2006 |
| JP | 10-187104 | A | 7/1998 |
| JP | 2001-184034 | A | 7/2001 |
| JP | 2002-040390 | A | 2/2002 |
| JP | 2004-286803 | | 10/2004 |
| JP | 2004-286803 | A | 10/2004 |
| JP | 2005-122061 | A | 5/2005 |
| JP | 2005-197177 | | 7/2005 |
| JP | 2006-113229 | A | 4/2006 |
| JP | 2008-165239 | | 7/2008 |
| TW | 482920 | | 4/2002 |
| TW | I251803 | | 3/2006 |
| TW | 200622983 | | 7/2006 |
| WO | WO 2006/080254 | | 8/2006 |

* cited by examiner

*Primary Examiner* — Sumati Lefkowitz
*Assistant Examiner* — Jonathan Horner
(74) *Attorney, Agent, or Firm* — McKenna Long & Aldridge, LLP

(57) ABSTRACT

Provided is a liquid crystal display device that can improve the image quality of a moving image. The liquid crystal display device includes a driver, a backlight unit, a first lamp driver, a second lamp driver, and a lamp driving controller. The liquid crystal panel divided is into at least three regions, and has a plurality of lamps arranged to correspond to each of the divided regions. Lamps of the lamps arranged in upper and lower regions of the liquid crystal panel are connected to each other. The first lamp driver controls on/off times of the lamps in the upper and lower regions of the liquid crystal panel. The second lamp driver controls on/off times of the lamps in the region excluding the upper and lower regions of the liquid crystal panel. The lamp driving controller controls the first and second lamp drivers using signals supplied from the driver.

10 Claims, 5 Drawing Sheets

LIQUID CRYSTAL DISPLAY DEVICE AND METHOD FOR DRIVING THE SAME

This application claims the benefit of Korean Patent Application No. 10-2006-0134589, filed on Dec. 27, 2006, which is hereby incorporated by reference for all purposes as if fully set forth herein.

BACKGROUND OF THE INVENTION

Field of the Invention

The present disclosure relates to a liquid crystal display (LCD) device, and more particularly, to an LCD device that can improve image quality of a moving image, and a driving method thereof.

Liquid crystal display (LCD) devices have been used in an increasing number of applications because of their characteristic light weight, slim profile, and low power consumption. In keeping with this trend, the LCD device is widely used for office automation devices and audio/video devices. The LCD device displays a desired image on a screen by controlling light transmittance according to image signals applied to a plurality of control switches arranged in a matrix configuration.

Because of their characteristic slim profile and low power consumption, LCD devices have gradually replaced cathode ray tubes (CRTs). This replacement trend has been accelerated by technological innovations that have improved the image quality that is obtainable by LCD devices. In particular, as the demand for devices displaying moving images such as television image has increased, improvements in the liquid crystal material or a driving method thereof have been made.

A CRT uses impulse type emission produced by scanning of an electron gun while the LCD device uses hold type emission produced using a backlight system that uses a linear lamp (fluorescent lamp) as an illumination light source. Accordingly a complete moving image is difficult to display properly using the LCD device. In the case where the LCD device displays a moving image, motion blurring (deterioration in the outline of a moving image) is generated and image quality reduces due to the hold characteristic.

To prevent motion blurring (deterioration in the outline of a moving image) while displaying a moving image, an LCD device employing a backlight sequential driving method using a direct type backlight unit including a plurality of lamps arranged horizontally has developed.

The LCD device using the backlight sequential driving method turns on a backlight using a plurality of lamps in synchronization with a start time of a scanning signal of a display image, and simultaneously, allows the display brightness of an LC panel to have a uniform time integral of a brightness value between frames to thereby prevent the deterioration in the outline of a moving image by displaying the moving image through impulse type emission (illumination) equivalent to that of a CRT.

FIG. 1 shows a related art LCD device.

As illustrated in FIG. 1, the related art LCD device includes an LC panel 2 including a plurality of gate lines GL1-GLn crossing a plurality of data lines DL1-DLm, and thin film transistors (TFTs) formed on regions defined by the crossings, a gate driver 4 for supplying a gate scan signal to the gate lines GL1-GLn of the LC panel 2, a data driver 6 for supplying data to the data lines DL1-DLm of the liquid crystal (LC) panel 2, a backlight unit 10 for illuminating light onto the LC panel 2, a lamp driver 12 for controlling the backlight unit 10, and a timing controller 8 for controlling the gate driver 4 and the data driver 6, and simultaneously, driving the lamp driver 12.

The backlight unit 10 includes lamps for generating light and optical sheets for directing the light generated from the lamps onto the LC panel 2. An image is displayed on the LC panel 2 using the light emitted from the backlight unit 10. The lamps of the backlight unit 10 are driven by a lamp driving voltage supplied from the lamp driver 12 to generate light. The lamps of the backlight unit 10 are sequentially driven in response an output from the lamp driver 12.

FIG. 2 is a view illustrating the related art backlight unit and lamp driver of FIG. 1.

As illustrated in FIGS. 1 and 2, a plurality of lamps 1 are arranged inside the backlight unit 10, and the plurality of lamps 1 are provided in groups of at least two lamps driven by one lamp driver. For example, four lamps of the lamps 1 located at the upper end are grouped into one bundle and are driven by a first inverter 12*a* of the lamp driver 12. Four additional lamps of the lamps 1 located at the lower end are grouped into one bundle and driven by a third inverter 12*c* of the lamp driver 12. The lamps 1 located on the central portion excluding the upper end and the lower end are grouped into one bundle and driven by a second inverter 12*b* of the lamp driver 12.

When the lamps 1 are driven according to the sequential driving method, the above-described motion blurring (deterioration in the outline of a moving image) can be prevented. The sequential driving method sequentially and repeatedly turns on and off the lamps 1 to prevent motion blurring (deterioration in the outline of a moving image). Ideally, when lamps are provided in numbers corresponding to the number of gate lines arranged on the LC panel 2 and are sequentially driven, motion blurring can be effectively prevented.

However, since the number of the lamps 1 that can be arranged in the backlight unit 10 is limited and adding additional lamps increases manufacturing costs, a plurality of lamps are grouped together for each region of the display and the lamps in each of the groups are driven simultaneously. When the number of regions where a portion of the lamps 1 is grouped and driven simultaneously increases, the number of inverters inside the lamp driver 12 for driving the lamps 1 also increases making device construction more complicated. On the other hand, when the number of lamps simultaneously driven by one inverter is increased to simplify the construction, motion blurring is generated.

SUMMARY OF THE INVENTION

Accordingly, the present invention is directed to a liquid crystal display device that substantially obviates one or more of the problems due to limitations and disadvantages of the related art.

An advantage of the present invention is to provide a liquid crystal display device that can improve image quality of a moving image, and a driving method thereof.

Another advantage of the present invention is to provide a liquid crystal display device using simplified circuitry and a driving method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a driver for driving a liquid crystal panel; a backlight unit including a plurality of lamps dividing the liquid crystal panel into at least three regions including an upper region and a lower region, and having lamps of the plurality of lamps arranged to correspond to each of the at least three regions, the lamps of the plurality of lamps corresponding to the upper and lower regions of the liquid crystal panel being connected to each other; a first lamp driver for controlling on and off times of the lamps arranged in the upper and lower regions of the liquid crystal panel; a second lamp driver for controlling on and off times of the lamps arranged in a region of the at least three regions excluding of the upper and lower regions of the liquid crystal panel; and a lamp driving controller for controlling the first and second lamp drivers using signals supplied from the driver.

In another aspect of the present invention, a driver for driving a liquid crystal panel; and a backlight unit having a plurality of lamps dividing the liquid crystal panel into at least three regions including an upper region and a lower region, lamps of plurality of lamps arranged to correspond to each of the at least three regions, the lamps of the lamps corresponding to the upper and lower regions of the liquid crystal panel being connected to each other is provided, the method comprising: generating a control signal for controlling on and off times of the lamps arranged in the upper and lower regions of the liquid crystal panel using a signal supplied from the driver, and a control signal for controlling on/off times of the lamps arranged in a region of the at least three regions excluding the upper and lower regions of the liquid crystal panel; turning on the lamps arranged in the region excluding the upper and lower regions of the liquid crystal panel; turning on the lamps arranged in the upper and lower regions of the liquid crystal panel; and displaying an image on the liquid crystal panel as the plurality of lamps are turned on.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present disclosure, an example of which is illustrated in the accompanying drawings.

Figure 1:
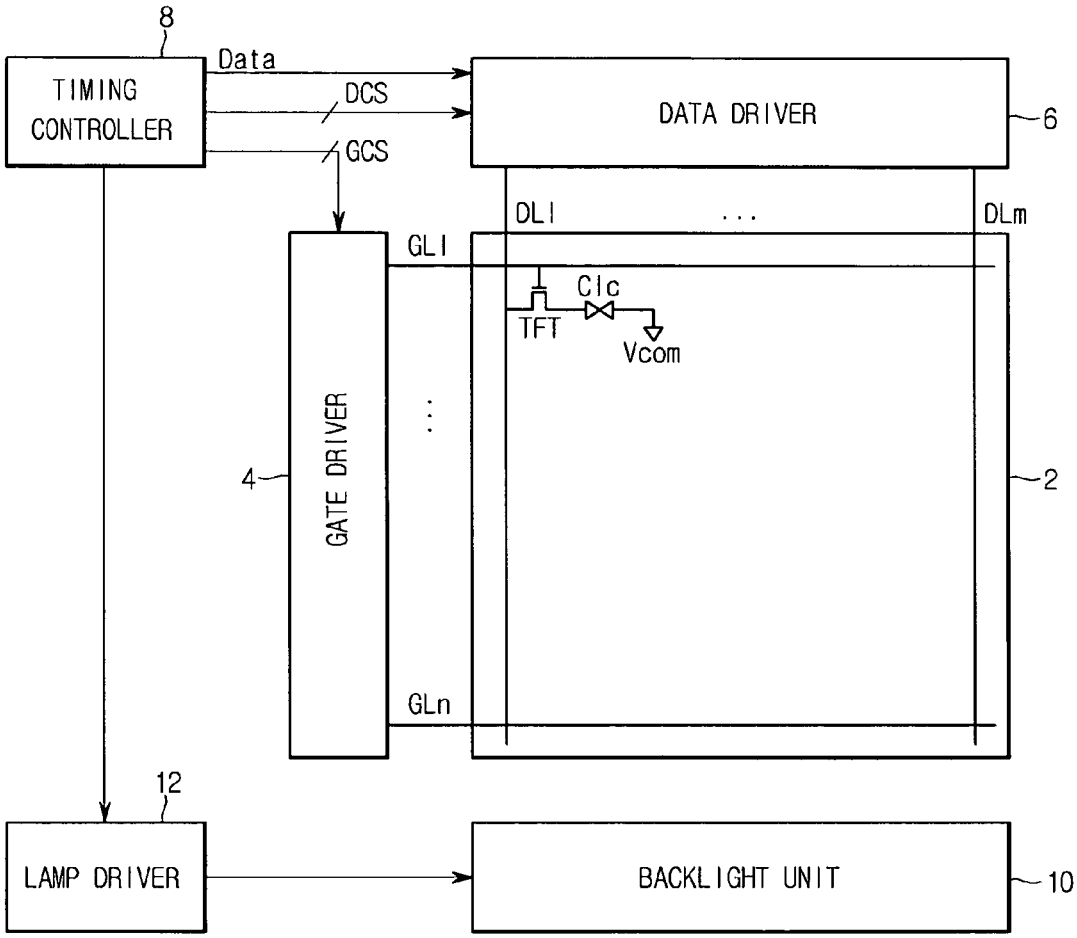
FIG. 1 is a view of a related art liquid crystal display (LCD) device.
Figure 2:
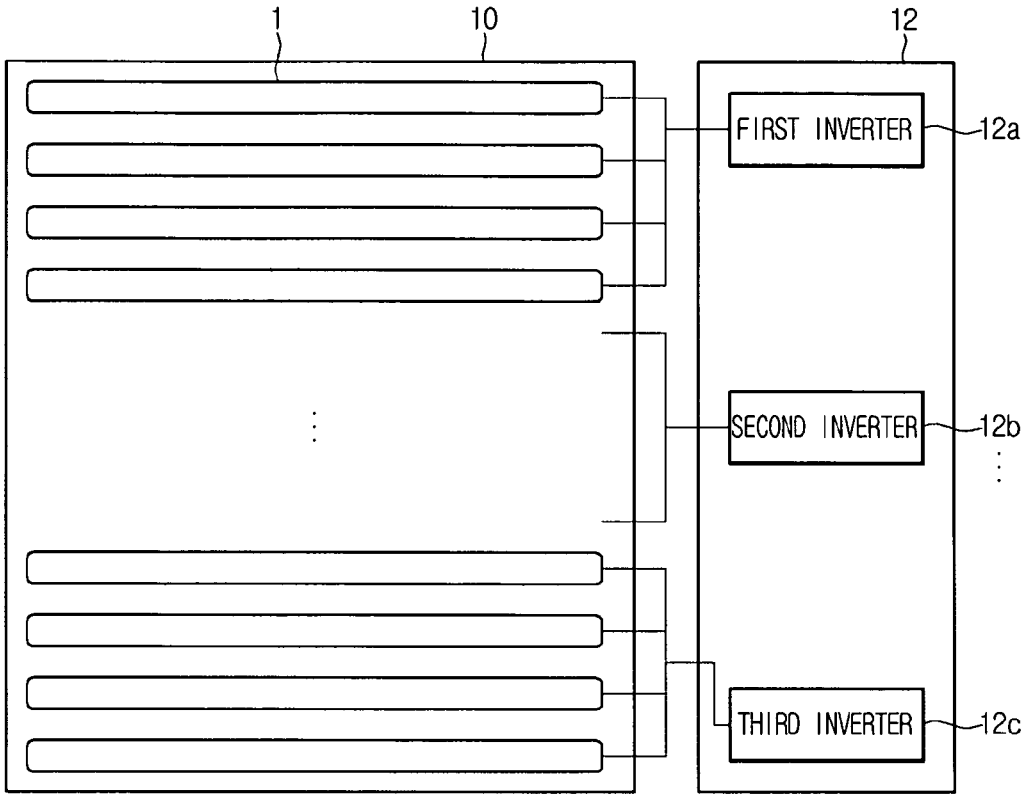
FIG. 2 is a view illustrating the backlight unit and the lamp driver of FIG. 1.
Figure 3:
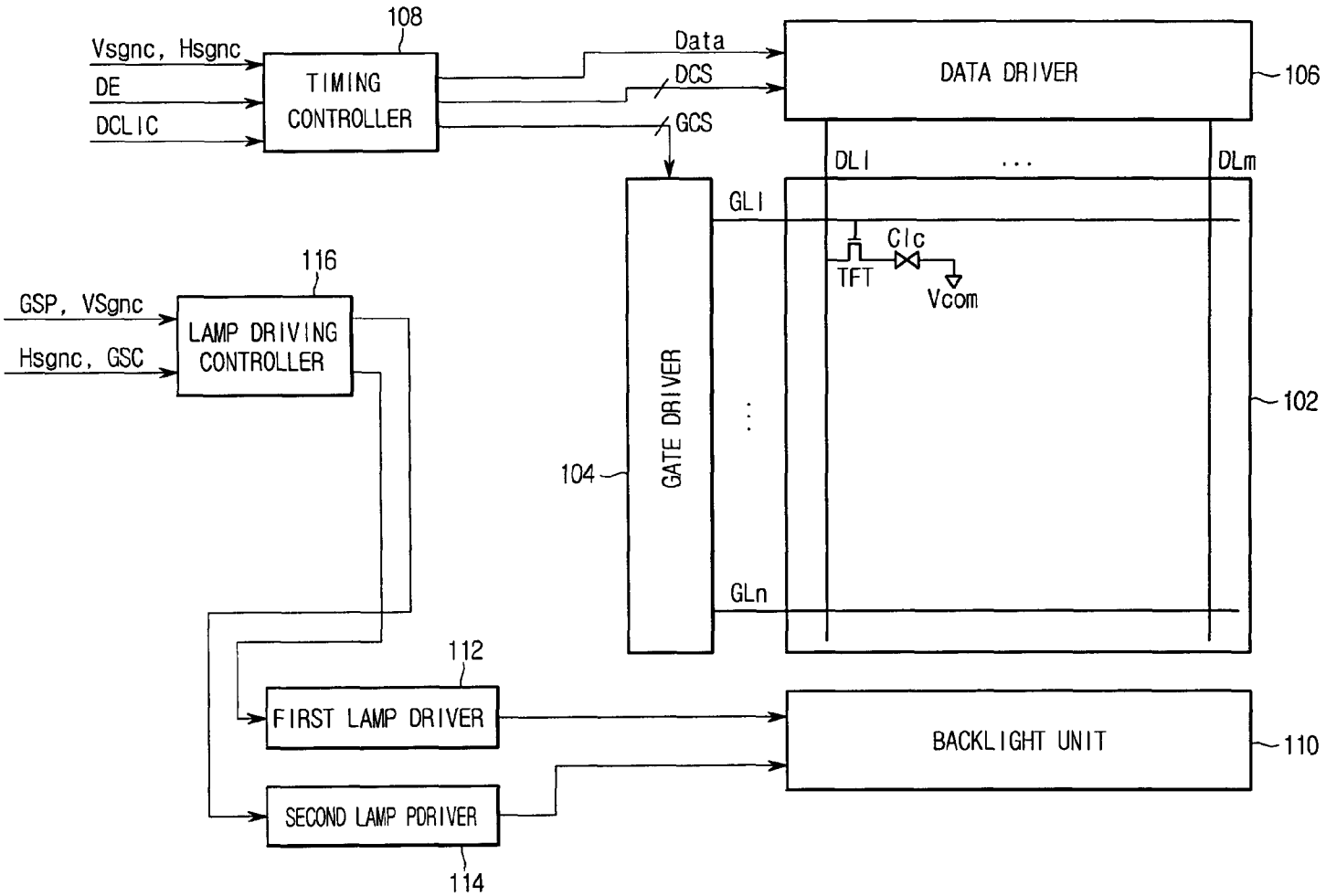
FIG. 3 is a view of an LCD device according to an embodiment of the present invention.

FIG. 3 is a view of a liquid crystal display (LCD) device according to an embodiment of the present invention.

Referring to FIG. 3, the LCD device includes a liquid crystal (LC) panel 102 for displaying an image, a gate driver 104 for driving a plurality of gate lines GL1-GLn on the LC panel 102, a data driver 106 for driving a plurality of data lines DL1-DLm on the LC panel 102, a timing controller 108 for controlling driving timing of the gate driver 104 and the data driver 106, and a backlight unit 110 for generating light and emitting the light onto the LC panel 102.

The LCD device further includes first and second lamp drivers 112 and 114 for generating a lamp driving voltage for driving the backlight unit 110 and a lamp driving controller 116 for controlling the first and second lamp drivers 112 and 114.

The LC panel 102 includes pixels formed on regions defined by crossings of the plurality of gate lines GL1-GLn and the plurality of data lines DL1-DLm. Each pixel includes a TFT formed at a crossing between a corresponding gate line GL and a corresponding data line DL, and an LC cell Clc connected between the TFT and a common electrode Vcom.

The TFT switches a pixel data voltage supplied from a corresponding data line DL to the corresponding LC cell Clc in response to a gate scan signal on the corresponding gate line GL. The LC cell Clc includes a pixel electrode connected between the common electrode and the TFT facing each other with an LC layer interposed therebetween. The LC cell Clc charges a pixel data voltage supplied via the corresponding TFT. The voltage charged to the LC cell Clc is updated whenever the corresponding TFT is turned-on.

In addition, each pixel on the LC panel 102 includes a storage capacitor Cst connected between the TFT and a previous gate line. The storage capacitor Cst minimizes natural reduction of the voltage charged at the LC cell Clc until a new pixel voltage is supplied to the LC cell Clc.

The LC panel 102 is divided into a plurality of regions. The LC panel 102 can be divided into a plurality of regions by lamps arranged in the backlight unit 110. For example, the LC panel 102 can be divided into an upper region, a lower region, and a central region.

The gate driver 104 supplies a plurality of gate scan signals to the plurality of gate lines GL1-GLn in response to corresponding gate control signals GCS from the timing controller 108. The plurality of gate scan signals GCS allow the plurality of gate lines GL1-GLn to be sequentially enabled by the period of one horizontal synchronization signal.

The data driver 106 generates a plurality of pixel data voltages to supply the same to the plurality of data lines DL1-DLm, respectively, whenever a gate line of the plurality of gate lines GL1-GLn is enabled in response to data control signals DCS from the timing controller 108. For this purpose, the data driver 106 receives pixel data from the timing controller 108 by an amount of one line, and converts the input pixel data corresponding to the amount of one line into analog pixel data voltages using a gamma voltage set.

The timing controller 108 generates the gate control signals GCS, data control signals DCS, and polarity inversion signal POL using a data clock DCLK, a horizontal synchronization signal Hsync, a vertical synchronization signal Vsync, and a data enable signal DE from an external system not shown (for example, a graphic module of a computer system or an image demodulation module of a television reception system). The gate control signals GCS and the polarity inversion signals POL are supplied to the data driver 106.

The backlight unit 110 includes a plurality of lamps, optical sheets for allowing light generated from the plurality of lamps to have uniform brightness and allowing the light having the uniform brightness to be illuminated onto the LC panel 102, and members for supporting the optical sheets on the lamps. The detailed description of the backlight unit 110 will be made later with reference to FIG. 5.

The first and second lamp drivers 112 and 114 generate a lamp driving voltage for driving the lamps arranged in the backlight unit 110 to supply the lamp driving voltage to the lamps of the backlight unit 110 under control of the lamp driving controller 116. The first and second lamp drivers 112 and 114 can include an inverter.

The lamp driving controller 116 controls timing with which the first and second lamp drivers 112 and 114 supply a lamp driving voltage to the backlight unit 110 in response to a signal supplied from an outside. The lamp driving controller 116 is described below in detail.

Figure 4:
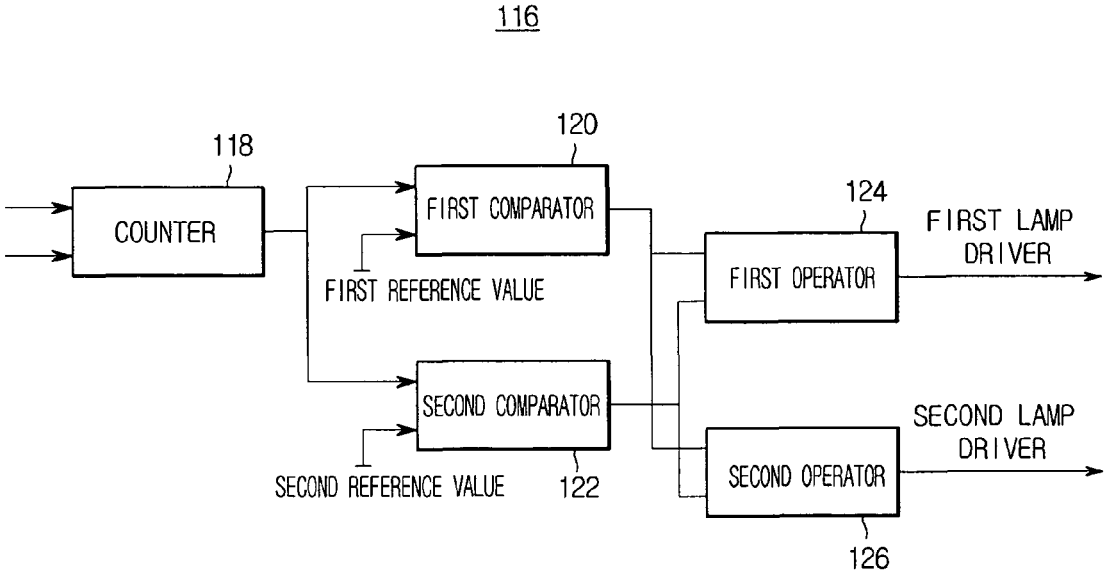
FIG. 4 is a block diagram illustrating details of the lamp driving controller shown in FIG. 3.

FIG. 4 is a block diagram illustrating details of the lamp driving controller shown in FIG. 3.

Referring to FIGS. 3 and 4, the lamp driving controller 116 includes a counter 118, a first comparator 120, a second comparator 122, a first operator 124, and a second operator 126. The counter 118 counts the number of times a high pulse of a gate shift clock GSC of gate control signals GCS generated from the timing controller 108 of FIG. 3 is input. The first comparator 120 compares a value counted by the counter 118 with a first reference value to generate a first comparison signal as a result of the comparison. The second comparator 122 compares a value counted by the counter 118 with a second reference value to generate a second comparison signal as a result of the comparison. The first operator 124 performs a logical operation on the first comparison signal and the second comparison signal to generate a first control signal. The second operator 126 performs a logical operation on the first comparison signal and the second comparison signal to generate a second control signal.

The counter 118 counts the number of times a high pulse of a gate shift clock GSC supplied from the timing controller 108 is input to supply the count value to the first and second comparators 120 and 122. The counter 118 is initialized by a gate start pulse GSP. The counter 118 counts a horizontal synchronization signal Hsync supplied from an external system, and simultaneously, is initialized by a vertical synchronization signal Vsync supplied from the external system. The count value corresponds to the location of LC cells, i.e., a line on which data corresponding to an amount of one line to be supplied to the data driver 106 is to be recorded The first comparator 120 compares a count value from the counter 118 with the first reference value to generate a first comparison signal as a result of the comparison. The first reference value indicates a boundary value of a first region defined by the lamps arranged in the backlight unit 110. The LC panel 102 is divided into three regions including the upper and lower regions and the central region as described above. The first reference value indicates a boundary value corresponding to a gate line between the upper region and the central region of the LC panel 102. For example, assuming that one hundred gate lines are arranged in the upper region of the LC panel 102, two hundred gate lines are arranged in the central region of the LC panel 102, and one hundred gate lines are arranged in the lower region of the LC panel 102, the first reference value can be a count of 100 corresponding to a hundredth gate line.

When the count value from the counter 118 is greater than the first reference value (hundredth gate line), the first comparator 120 generates a first high comparison signal. When the count value from the counter 118 is smaller than the first reference value (hundredth gate line), the first comparator 120 generates a first low comparison signal. The first high and low comparison signals generated by the first comparator 120 are supplied to the first and second operators 124 and 126.

The second comparator 122 compares a count value from the counter 118 with the second reference value to generate a second comparison signal as a result of the comparison result. The second reference value corresponds to a boundary value of a second region defined by the lamps arranged in the backlight unit 110. Since the LC panel 102 is divided into three regions of the upper and lower regions and the central region as described above, the second reference value corresponds to gate line at a boundary value between the lower region and the central region of the LC panel 102. For example, assuming that one hundred gate lines are arranged in the upper region of the LC panel 102, two hundred gate lines are arranged in the central region of the LC panel 102, and one hundred gate lines are arranged in the lower region of the LC panel 102, the second reference value can be 300 indicating a three hundredth gate line.

When the count value from the counter 118 is greater than the second reference value (three hundredth gate line), the second comparator 122 generates a second high comparison signal. When the count value from the counter 118 is smaller than the second reference value (three hundredth gate line), the second comparator 122 generates a second low comparison signal. The second high and low comparison signals generated by the second comparator 122 are supplied to the first and second operators 124 and 126.

The first operator 124 performs a logical operation on the first and second comparison signals supplied from the first and second comparators 120 and 122 to generate the first control signal. The second operator 126 performs a logical operation on the first and second comparison signals supplied from the first and second comparators 120 and 122 to generate the second control signal. The second operator 126 performs the logical operation of providing the inverse of the first control signal generated by the first operator 124.

The first operator 124 outputs the first low control signal when the first high comparison signal and the second high comparison signal are supplied from the first and second comparators 120 and 122, respectively, or when the first low comparison signal and the second low comparison signal are supplied from the first and second comparators 120 and 122, respectively. In other words, the first operator 124 outputs the first low control signal when the first and second comparison signals having the same level are supplied from the first and second comparators 120 and 122. The first operator 124 outputs the first high control signal when the first and second comparison signals having levels different from each other are supplied from the first and second comparators 120 and 122. The first low and high control signals output from the first operator 124 are supplied to the first lamp driver 112, which is controlled by the first control signal generated by the first operator 124.

The second operator 126 outputs the second high control signal when the first high comparison signal and the second high comparison signal are supplied from the first and second comparators 120 and 122, respectively, or when the first low comparison signal and the second low comparison signal are supplied from the first and second comparators 120 and 122, respectively. In other words, the second operator 126 outputs the second high control signal when the first and second comparison signals having the same level are supplied from the first and second comparators 120 and 122. The second operator 126 outputs the second low control signal when the first and second comparison signals having levels different from each other are supplied from the first and second comparators 120 and 122. The second low and high control signals output from the second operator 126 are supplied to the second lamp driver 114, which is controlled by the second control signal generated by the second operator 126.

Figure 5:
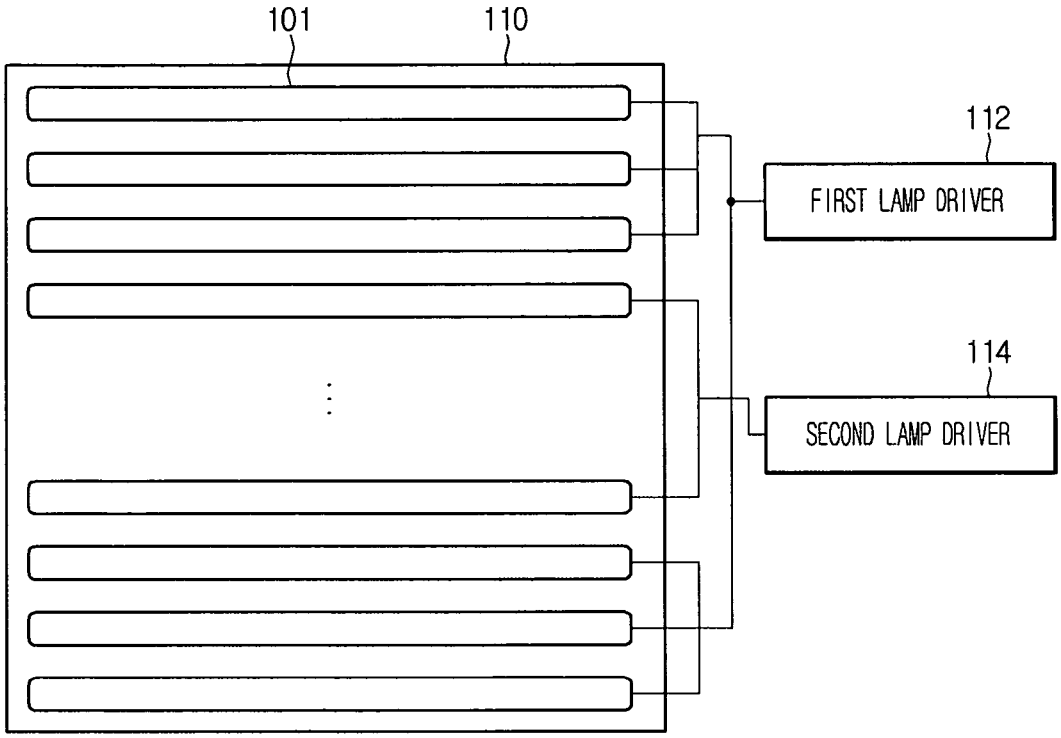
FIG. 5 is a view illustrating the backlight unit and the lamp driver of FIG. 3.

FIG. 5 is a view illustrating the backlight unit and the lamp driver shown in FIG. 3.

Referring to FIGS. 3 and 5, the backlight unit 110 includes a plurality of lamps 101. As described above, the LC panel 102 is divided into the upper and lower regions and the central region by the lamps 101 arranged in the backlight unit 110.

Three lamps of the lamps 101 arranged in the backlight unit 110 located in the upper region, and three lamps of the lamps 101 arranged in the backlight unit 110 located in the lower region are connected to and simultaneously driven by the first lamp driver 112. Lamps of the lamps arranged in the backlight unit 110 located in the central region are connected to and driven by the second lamp driver 114.

The first lamp driver 112 is controlled by the first control signal generated from the first operator 124 of FIG. 4, and the second lamp driver 114 is controlled by the second control signal generated from the second operator 126 of FIG. 4. The second lamp driver 114 allows lamps 101 connected to the second lamp driver 114 to be turned on first in response to the second control signal supplied from the second operator 126. After the lamps 101 connected to the second lamp driver 114 are turned, the first lamp driver 112 allows lamps 101 connected to the first lamp driver 112 to be turned on in response to the first control signal from the first operator 124. After lamps 101 located in the central region of the LC panel 102 are turned on, lamps 101 located in the upper and lower regions of the LC panel 102 are sequentially turned on.

In an example embodiment where the number of the lamps 101 arranged in the backlight unit 110 is twenty, five of the twenty lamps located in the upper region of the backlight unit 110, and five of the twenty lamps located in the lower region of the backlight unit 110 are connected to the first lamp driver 112, so that the ten lamps located in the upper and lower regions are simultaneously driven. The ten lamps arranged in the central region of the backlight unit 110 are connected to the second lamp driver 114.

If the number of the lamps 101 arranged in the backlight unit 110 is twenty four, six of the twenty four lamps located in the upper region of the backlight unit 110, and six of the twenty four lamps located in the lower region of the backlight unit 110 are connected to the first lamp driver 112, so that the twelve lamps located in the upper and lower regions are simultaneously driven. The twelve lamps arranged in the central region of the backlight unit 110 are connected to the second lamp driver 114 and driven.

Alternatively, four of the twenty four lamps located in the upper region of the backlight unit 110, and four of the twenty four lamps located in the lower region of the backlight unit 110 can be connected to the first lamp driver 112, so that the eight lamps located in the upper and lower regions can be simultaneously driven. The sixteen lamps arranged in the central region of the backlight unit 110 can be connected to the second lamp driver 114 and driven.

When the number of the lamps 101 arranged in the backlight unit 110 is twenty eight, six of the twenty eight lamps located in the upper region of the backlight unit 110, and six of the twenty eight lamps located in the lower region of the backlight unit 110 can be connected to the first lamp driver 112, so that the twelve lamps located in the upper and lower regions are simultaneously driven. The sixteen lamps arranged in the central region of the backlight unit 110 are connected to the second lamp driver 114 and driven.

Alternatively, eight of the twenty eight lamps located in the upper region of the backlight unit 110, and eight of the twenty eight lamps located in the lower region of the backlight unit 110 can be connected to the first lamp driver 112, so that the sixteen lamps located in the upper and lower regions are simultaneously driven. The twelve lamps arranged in the central region of the backlight unit 110 are connected to the second lamp driver 114 and driven.

As described above, the lamps 101 located in the central region of the LC panel 102 are turned on first, and the lamps 101 located in the upper and lower regions of the LC panel 102 are sequentially turned on, so that the backlight unit 110 is driven according to the sequential driving method. Therefore, motion blurring (deterioration in the outline of a moving image) can be prevented. The number of the lamp drivers can be reduced by simultaneously driving the upper and lower regions of the LC panel 102 using the first lamp driver 112. Since the number of the lamp drivers is reduced, the structure of the lamp driving circuitry can be simplified.

As described above, the backlight unit according to an embodiment drives the lamps arranged in the central region of the LC panel and then sequentially drives the lamps arranged in the upper and lower regions of the LC panel to prevent motion blurring (deterioration in the outline of a moving image).

The backlight unit according to an embodiment drives the lamps arranged in the upper and lower regions of the LC panel using one lamp driver to reduce the number of lamp drivers driving the lamps, so that the lamp driver circuitry can be simplified.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a driver for driving a liquid crystal panel;

a backlight unit including a plurality of lamps dividing the liquid crystal panel into three regions including a center region, an upper region and a lower region, and having lamps of the plurality of lamps arranged to correspond to each of the three regions, the lamps of the plurality of lamps corresponding to the upper and lower regions of the liquid crystal panel being connected to each other;

a first lamp driver for controlling on and off times of the lamps arranged in the upper and lower regions of the liquid crystal panel;

a second lamp driver for controlling on and off times of the lamps arranged in the center region of the three regions excluding the upper and lower regions of the liquid crystal panel; and a lamp driving controller for controlling the first and second lamp drivers using signals supplied from the driver, wherein the lamps in the center region of the liquid crystal panel are simultaneously driven, wherein the lamps in the center region are turned on prior to turning on the lamps arranged in the upper and lower regions, wherein the lamps in the upper and lower regions are simultaneously driven by the first lamp driver, wherein the lamps arranged in the upper and lower regions are simultaneously turned on, and wherein the lamps arranged in the center region are simultaneously turned on.

2. The liquid crystal display device according to claim 1, wherein the lamp driving controller comprises:

a counter for receiving and counting a gate shift pulse signal to calculate a count value;

a first comparator for comparing the count value from the counter with a first reference value to generate a first comparison signal as a result of the comparison;

a second comparator for comparing the count value from the counter with a second reference value to generate a second comparison signal as a result of the comparison;

a first operator for performing logical operation on the first and second comparison signals to generate a first control signal; and a second operator for performing logical operation on the first and second comparison signals to generate a second control signal, the second control signal having an inverse logic state from the first control signal.

3. The liquid crystal display device according to claim 2, wherein the counter is initialized by a gate start pulse signal.

4. The liquid crystal display device according to claim 2, wherein the counter counts a horizontal synchronization signal.

5. The liquid crystal display device according to claim 3, wherein the counter is initialized by a vertical synchronization signal.

6. A method for driving a liquid crystal display device including: a driver for driving a liquid crystal panel; and a backlight unit having a plurality of lamps dividing the liquid crystal panel into three regions including an upper region, a center region and a lower region, lamps of plurality of lamps arranged to correspond to each of the three regions, the lamps of the lamps corresponding to the upper and lower regions of the liquid crystal panel being connected to each other, the method comprising:

generating a control signal for controlling on and off times of the lamps arranged in the upper and lower regions of the liquid crystal panel using a signal supplied from the driver, and a control signal for controlling on and off times of the lamps arranged in the center region of the three regions excluding the upper and lower regions of the liquid crystal panel;

turning on the lamps arranged in the center region excluding the upper and lower regions of the liquid crystal panel;

turning on the lamps arranged in the upper and lower regions of the liquid crystal panel; and displaying an image on the liquid crystal panel as the plurality of lamps are turned on, wherein the lamps in the center region of the liquid crystal panel are simultaneously driven, wherein the lamps in the center region are turned on prior to turning on the lamps arranged in the upper and lower regions, wherein the lamps in the upper and lower regions are simultaneously driven by the first lamp driver, wherein the lamps arranged in the upper and lower regions are simultaneously turned on, and wherein the lamps arranged in the center region are simultaneously turned on.

7. The method according to claim 6, wherein the generating of the control signal comprises:

counting a received gate shift pulse signal to calculate the count value;

comparing the count value with a first reference value to generate a first comparison signal as a result of the comparison result;

comparing the count value with a second reference value to generate a second comparison signal as a result of the comparison result;

performing a logical operation on the first and second comparison signals to generate a first control signal; and performing a logical operation on the first and second comparison signals to generate a second control signal having a logic state that is the inverse of a logic state of the first control signal.

8. The method according to claim 7, wherein a counter for counting the gate shift pulse signal is initialized by a gate start pulse signal.

9. The method according to claim 7, wherein the calculating of the count value comprises counting a horizontal synchronization signal.

10. The method according to claim 7, wherein a counter for counting the gate shift pulse signal is initialized by a vertical synchronization signal.

* * * * *